US006932686B1

(12) United States Patent
Carruth

(10) Patent No.: US 6,932,686 B1
(45) Date of Patent: Aug. 23, 2005

(54) PISTON RING GRINDER

(75) Inventor: Brian C. Carruth, Burbank, OH (US)

(73) Assignee: Autosales, Incorporated, Tallmadge, OH (US)

( * ) Notice: Subject to any disclaimer, the term of this patent is extended or adjusted under 35 U.S.C. 154(b) by 0 days.

(21) Appl. No.: 10/755,262

(22) Filed: Jan. 12, 2004

(51) Int. Cl.[7] ..... B24B 7/16; B24B 23/02
(52) U.S. Cl. ..... 451/359; 451/278
(58) Field of Search ..... 451/359, 460, 451/51, 278, 279, 403, 404, 365; 29/76.1

(56) References Cited

U.S. PATENT DOCUMENTS

| | | | | |
|---|---|---|---|---|
| 1,540,765 A | * | 6/1925 | Daniels | 409/197 |
| 1,750,195 A | * | 3/1930 | Sanders | 451/276 |
| 1,916,783 A | * | 7/1933 | Daniels | 451/278 |
| 2,013,262 A | * | 9/1935 | Wilsey | 451/278 |
| 2,055,373 A | * | 9/1936 | Zilliox | 29/76.1 |
| 2,487,670 A | * | 11/1949 | Pezous | 451/278 |
| 4,964,240 A | | 10/1990 | Martino | 51/125.5 |

OTHER PUBLICATIONS

Summit Racing Universal Piston Ring Filer, online catalog excerpt, 1 page (Jan. 26, 2004).

Summit Racing Manual Piston Ring Filer, online catalog excerpt, 1 page (Jan. 26, 2004).

Manley Performance Products, Inc., Piston Ring End Gapping Tool, advertisement, 1 page (undated).

* cited by examiner

*Primary Examiner*—Robert A. Rose
(74) *Attorney, Agent, or Firm*—Renner, Kenner, Greive, Bobak, Taylor & Weber

(57) ABSTRACT

A piston ring grinding device (10) includes a base portion (12) which is provided with spaced collars (21, 22) which receive an axle (28). A grinding wheel (26) having an abrasive surface (27) is carried by the axle (28), and a handle assembly (30) is provided for rotation of the axle (28) and the grinding wheel (26). The axle (28) may be received in either the first collar (21) or the second collar (22) for selective right hand or left hand operation of the device (10). An adjustable locator (60) is Y-shaped having an elongate body (62) with a channel (70) therein and branches (64, 65) which provide contact points (68, 69) for the piston ring (R). Once the piston ring (R) is engaging the contact points (68, 69), and thereby properly positioned on the base portion (12), a thumbscrew (73) may be tightened to attach the locators (60) to the base portion (12), and the ends of the piston ring (R) are ready to be ground.

16 Claims, 3 Drawing Sheets

PISTON RING GRINDER

TECHNICAL FIELD

The present invention relates to a device for grinding the end portions of piston rings.

BACKGROUND ART

Generally, there are three piston rings used in a cylinder of an internal combustion engine: the top ring, the second ring, and the oil ring. The three piston rings are positioned around a piston capable of reciprocal movement within the cylinder. For example, the piston is cylindrical, and the top ring, the second ring, and the oil ring are respectively spaced in vertically descending order there along. The combination of all three piston rings serves to isolate the combustion chamber from the crankcase.

The top ring serves two purposes: preventing gases (from the combustion chamber) from passing there around, and transferring heat from the piston to the engine block through the walls of the cylinder. The oil ring prevents oil (from the crankcase) from passing there around. The second ring compliments both the top ring and the oil ring. The second ring prevents gases (which bypassed the top ring) from passing there around, and prevents oil (which bypassed the oil ring) from passing there around. Consequently, the top ring, the second ring, and the oil ring are seals for preventing the passage of gases and/or oil. Without the isolation of the combustion chamber and the crankcase provided by the piston rings, the presence of gases in the crankcase and oil in the combustion chamber would decrease the horsepower of the internal combustion engine.

To serve as seals, the top ring and second ring springingly engage the walls of the cylinder. For example, in the "free state" before installation, the top ring and second ring are biased to expand. That is, the top ring and second ring have expanded diameters forming a gap between their respective ends. When the top ring and second ring are installed around the piston, the ends of each ring are squeezed together. Thereafter, the piston and the surrounding rings are inserted into the cylinder. Because each ring is biased to expand toward its "free state," the top ring and the bottom ring expand against the walls of the cylinder. As such, the top ring and the bottom ring springingly engage the walls of the cylinder, and serve to effectuate the above-discussed seal between the combustion chamber and the crankcase.

For normal use, it is generally unnecessary to "fit" the gaps between the ends of the top ring and the second ring to precise tolerances. However, for high performance/racing applications, fitting the gaps can used provide a competitive advantage. For example, the top rings and the second rings used in racing applications are often sold with oversized dimensions, and, therefore, provide small gaps between their ends. Consequently, before installation, the ends of the top rings and second rings can be filed and refiled to provide gaps of different sizes. Such different sized gaps provide for different separations between the ends when the piston rings are installed.

The filing and refiling allows the performance of the various gap sizes (and corresponding separations) to be tested, and such experimentation can enhance the performance of an internal combustion engine. For example, because internal combustion engines used in racing operate at high temperatures, it is necessary to provide a gap allowing for expansion of the piston rings according to the high temperatures. Thus, a properly sized gap would allow the ends to be initially separated when the piston rings are inserted into the cylinder, which separation could thereafter close when the piston rings expand due to exposure to high temperatures.

However, if the gaps are sized too small, the ends will close before the piston rings are finished expanding, and the piston rings will warp, thereby causing "scuffing" of the walls of the cylinder. Moreover, if the ends are misaligned, the ends will touch unevenly, which will not only cause unwanted separation therebetween before the piston rings are finished expanding, but which might also force the piston rings to expand awkwardly, thereby also causing "scuffing" of the walls of the cylinder. Consequently, the gaps must be precisely sized, and the ends must be properly aligned with respect to one another.

At present, most known manually operated devices which assist in the grinding of the ends of the piston rings rely on the manual placement and holding of the ring. That is, one hand of the user attempts to steadily hold the ring while the other hand performs the grinding process. But such manual operation has been found not to provide for continued, repeated, accurate grinding. Moreover, such manual devices do not readily accommodate piston rings of varying sizes.

DISCLOSURE OF THE INVENTION

It is thus an object of the present invention to provide a device which will assist the user in the precise grinding of the ends of piston rings.

It is another object of the present invention to provide a device, as above, which will assist the user in providing a precision-sized gap between the ends of a piston ring.

It is a further object of the present invention to provide a device, as above, which will better assure the proper alignment of the ends of the piston rings after grinding.

It is an additional object of the present invention to provide a device, as above, which can be utilized for repeated precision piston ring grindings.

It is a still further object of the present invention to provide a device, as above, which can be adjusted for varying sizes of piston rings.

It is yet another object of the present invention to provide a device, as above, which is adaptable to right hand or left hand operation.

These and other objects of the present invention, as well as the advantages thereof over existing prior art forms, which will become apparent from the description to follow, are accomplished by the improvements hereinafter described and claimed.

In general, an apparatus for grinding the ends of a piston ring made in accordance with the present invention includes a base portion having a working surface for receiving the piston ring. An axle is rotatably supported by the base portion and has a first and second end. A grinding wheel having an abrasive surface is attached to the first end of the axle, and a handle assembly for rotating the wheel is attached to the second end of the axle. An adjustable locator is selectively positioned on the work surface to engage and locate the piston ring.

A preferred exemplary piston ring grinding device according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 4:
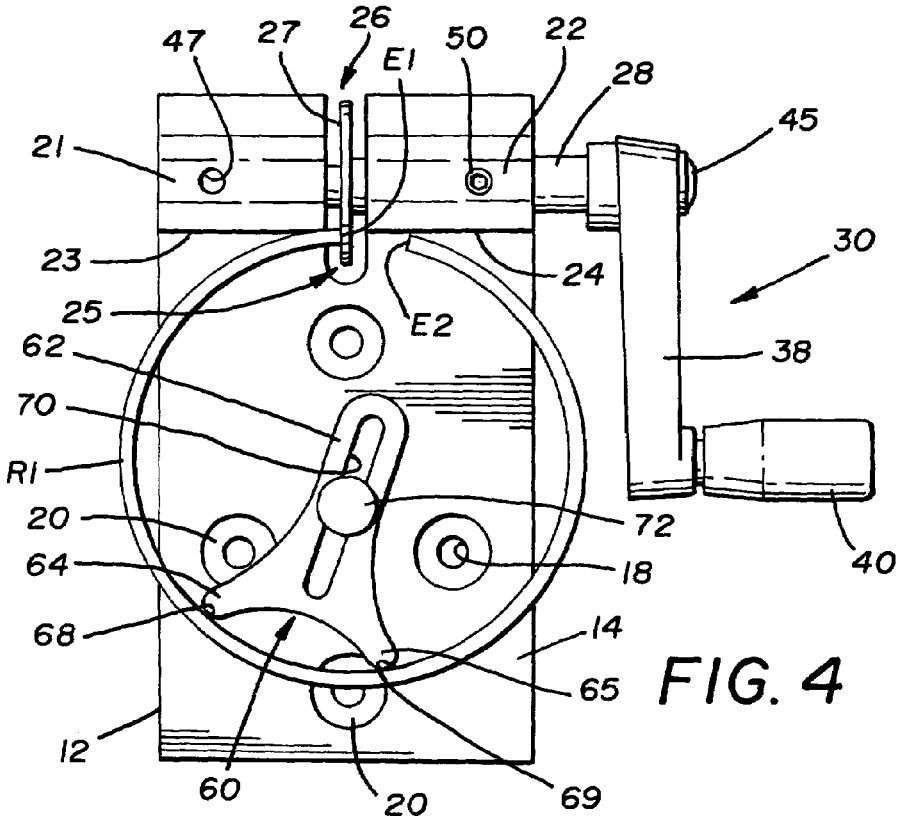
FIG. 4 is a plan view of the piston ring grinder depicting the grinding of a piston ring.
Figure 5:
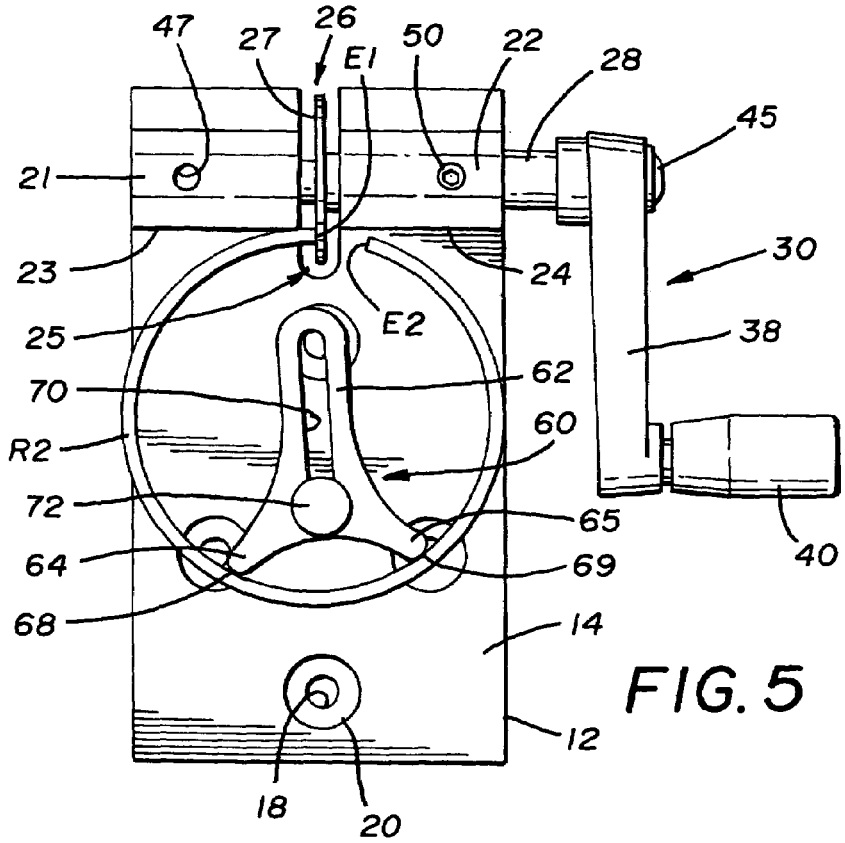
FIG. 5 is a plan view of the piston ring grinder depicting the grinding of a piston ring of a different size than that shown in FIG. 4.

A piston ring grinder made in accordance with the present invention is generally indicated by the numeral 10. Piston ring grinder 10 includes a base portion 12 having a work surface 14 adapted to receive a piston ring R1 or R2 (as seen in FIGS. 4 and 5). Base portion 12 includes a plurality of apertures 18 which have countersinks 20 and which can receive bolts (not shown) for bench-mounting of piston ring grinder 10. Countersinks 20 provide space for accommodating the bolts (specifically, the heads of the bolts) and allow work surface 14 to remain free of unwanted obstruction.

Base portion 12 includes first and second collars 21 extending upwardly from working surface 14. A first stop surface 23 and a second stop surface 24 are respectively formed on first collar 21 and second collar 22 adjacent to where first and second collars 21, 22 intersect work surface 14. A gap 25 is provided between first collar 21 and second collar 22 to separate the first stop surface 23 and the second stop surface 24, and to provide space for a grinding wheel 26 having at least one abrasive surface 27. Abrasive surface 27 is preferably diamond coated to provide a long lasting corrosion resistant finish. Grinding wheel 26 is ultimately attached to an axle 28 which is substantially cylindrical. As will be discussed hereinbelow, axle 28 is selectively, rotatably supported in either first collar 21 or second collar 22.

Figure 1:
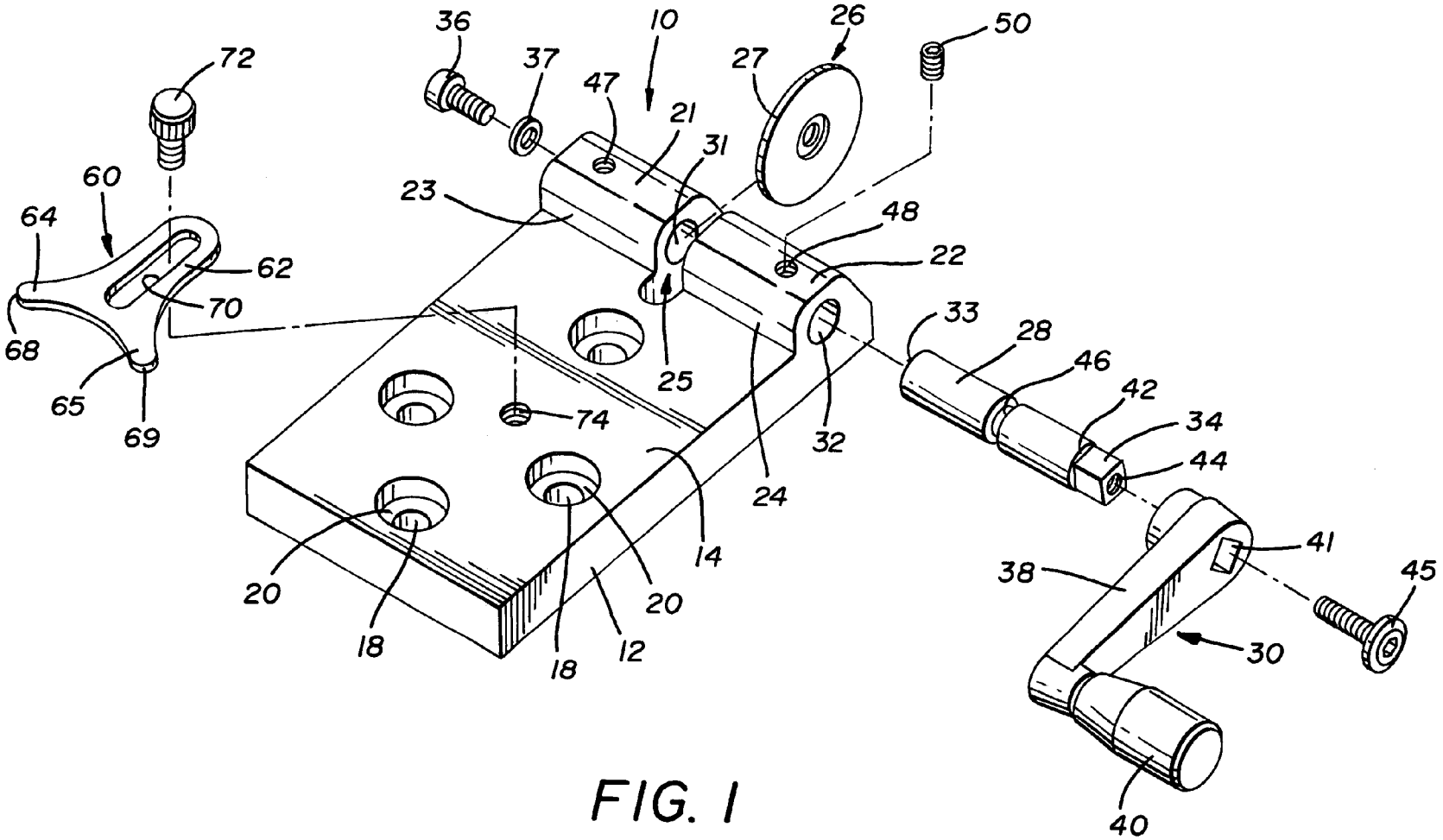
FIG. 1 is an exploded perspective view of a piston ring grinder made in accordance with the concepts of the present invention.
Figure 2:
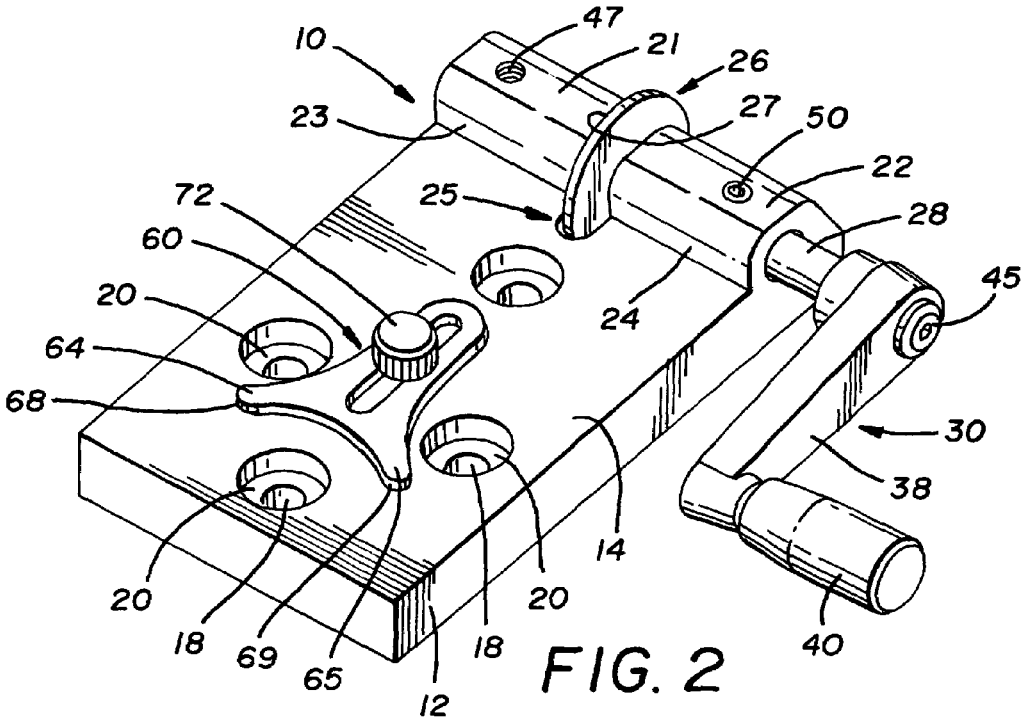
FIG. 2 is an assembled perspective view of the piston ring grinder.
Figure 3:
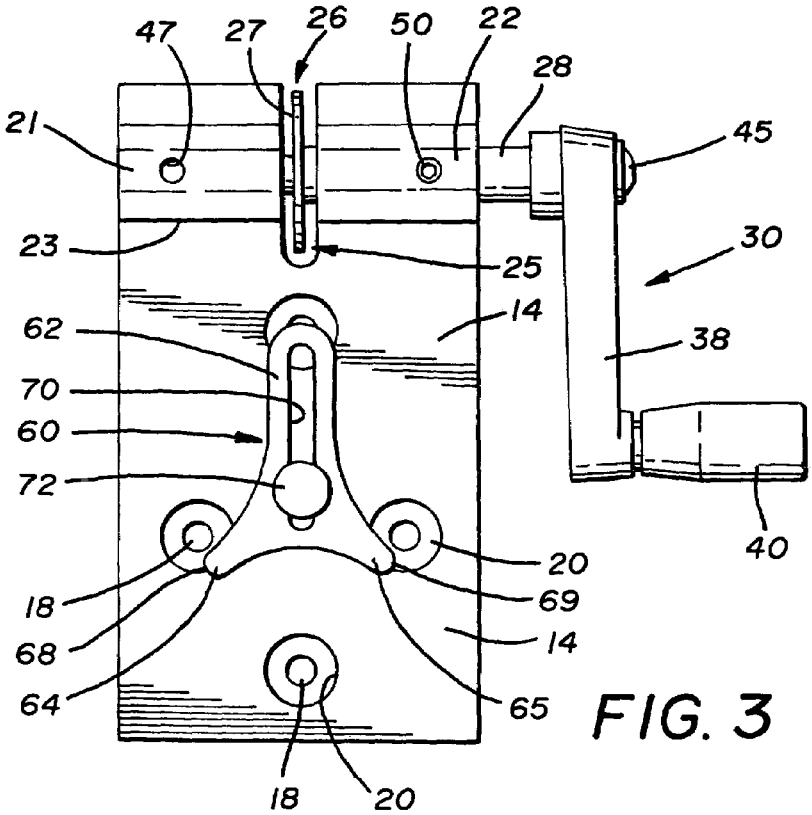
FIG. 3 is a plan view of the piston ring grinder.

The required orientation of abrasive surface 27 (facing to the right or to the left) determines the placement of axle 28 and an associated handle assembly generally indicated by the numeral 30. For example, axle 28 can be positioned in a cylindrical receiving hole 31 in first collar 21, and handle assembly 30 can be positioned on the left of base portion 12 (for left-hand operation) when abrasive surface 27 is facing to the right, or axle 28 can be positioned in a cylindrical receiving hole 32 in second collar 22, and handle assembly 30 can be positioned on the right of base portion 12 (for right-hand operation) when abrasive surface 27 is facing to the left. As seen in FIG. 1, both receiving holes 31 and extend outwardly from gap 25.

As viewed in FIGS. 2–5, abrasive surface 27 is facing to the left when piston ring grinder 10 is assembled. Therefore, in FIGS. 2–5, axle 28 is positioned in receiving hole 32 of second collar 22, and handle assembly 30 is positioned on the right of base portion 12 for right-hand operation. However, whether axle 28 is positioned in receiving hole 31 or receiving hole 32, handle assembly 30 is used to rotate grinding wheel 26. Axle 28 is rotatable within receiving holes 31 and 32, and includes a first end 33 and a second end 34. Grinding wheel 26 is attached to first end 33 (using a bolt 36 and complimentary washer 37), and second end 34 is attached to handle assembly 30. Therefore, turning handle assembly 30 (either clockwise or counterclockwise) rotates axle 28 and attached grinding wheel 26.

To facilitate rotation of grinding wheel 26 (and abrasive surface 27), handle assembly 30 includes a crank section 38 and a handle grip 40. Grip 40 can be fixedly or rotatably attached to crank section 38, and allows a user to turn handle assembly 30. Crank section 38 is attached to second end 34 of axle 28 and includes a receiving aperture 41 adapted to receive second end 34. Preferably, second end 34 has a square shape (as seen in FIG. 1), and receiving aperture 41 is shaped to match that shape of second end 34.

Second end 34 has a smaller size than the remainder of axle 28, and therefore, as seen in FIG. 1, an abutment shoulder 42 extends outwardly of the perimeter of second end 34 (adjacent the remainder of axle 28). Second end 34 of axle 28 also includes a threaded hole 44 adapted to receive a bolt-type fastener 45 so that handle assembly 30 can be secured to axle 28. Thus, when second end 34 is received in receiving aperture 41, crank section 38 abuts shoulder 42 and bolt-type fastener 45 can be inserted into threaded hole 44 to clamp crank section 38 against abutment shoulder 42, and therefore, secure handle assembly 30 to axle 28.

As discussed hereinabove, when piston ring grinder 10 is assembled, axle 28 is positioned in either receiving hole 31 or receiving hole 32. The axial position of axle 28 in receiving hole 31 or receiving hole 32 is maintained through the use of a channel 46 provided in the circumference of axle 28. To illustrate, first collar 21 and second collar 22, respectively, include set screw holes 47 and 48. Set screw holes 47 and 48, respectively, lead from the upper surfaces of first collar 21 and second collar 22 to holes 31 and 32. When axle 28 is inserted into either of receiving holes 31, 32, a set screw 50 can be inserted into the appropriate set screw hole 47, 48 and thereafter be received in channel 46, thereby preventing the axial movement of axle 28.

The orientation of abrasive surface 27 can easily be changed. For example, to change the orientation, grinding wheel 26 must be first removed from first end 33 of axle 28. To that end, bolt 36 and complimentary washer 37 are removed from first end 33 of axle 28, and set screw 50 is removed from its current position in one of set screw holes 47, 48. Axle 28 can then be removed from its current position, and is repositioned in either hole 31 or hole 32. Finally, grinding wheel 26 can be reattached to first end 33 of axle 28 with abrasive surface 27 facing the opposite direction (using bolt 36 and complimentary washer 37), and set screw 50 can be repositioned in the other of set screw holes 47, 48.

During operation of piston ring grinder 10, the piston rings must be properly positioned on work surface 14 so that an end thereof may be ground to provide a precision gap. To that end, an adjustable locator 60 is provided to insure proper positioning of the piston rings. For example, a larger piston ring R1 (as seen in FIG. 4) and a smaller piston ring R2 (as seen in FIG. 5) are properly positioned on work surface 14 using adjustable locator 60.

Adjustable locator 60 is generally Y-shaped having an elongated body portion 62, and angled branch sections 64 and 65 extending outwardly from elongated body portion 62. Angled branch sections 64 and 65, respectively, provide contact points 68 and 69 for engaging the piston rings R1 and R2.

The adjustable locator 60 can be selectively positioned on work surface 14 by means of a slide channel 70 formed in body portion 62 and adapted to receive a thumbscrew 72. Thus, slide channel 70 is preferably in the form of a slot extending along elongated body section 62. Thumbscrew 72 can be inserted through slide channel 70, and into a thumbscrew aperture 74 provided in base portion 12. As such, when thumbscrew 72 is loose, adjustable locator 60 can be properly positioned on work surface 14 by sliding slide channel 70 along thumbscrew 72. Once properly positioned, adjustable locator 60 can be fastened to work surface 14 by tightening thumbscrew 72.

As seen in FIGS. 4 and 5, piston rings R1 and R2 each have a first end E1 and a second end E2. To grind ends E1 and E2, and provide a precision gap therebetween, piston rings R1 and R2 are selectively located against one of the stop surfaces 23 or 24 (depending on the orientation of grinding wheel 26), and first ends E1 are positioned evenly against abrasive surface 27. Without changing the location of piston rings R1 and R2, thumbscrew 72 is loosened, and adjustable locator 60 is positioned so that contact points 68 and 69 touch the inner diameter of rings R1 and R2. After positioning adjustable locator 60, thumbscrew 72 is tightened.

Once the proper positions of piston rings R1 and R2 are established, and thereafter maintained, using adjustable locator 60, grinding wheel 26 can be rotated using handle assembly 30 to remove small amounts of material from ends E1 and E2. For example, the grinding operation can be performed to remove small amounts of materials from first ends E1. Subsequently, piston rings R1 and R2 can be repositioned on work surface 14, and the grinding operation can be repeated to remove small amounts of material from second ends E2.

Because adjustable locator 60 is used, the grinding operation performed on first ends E1 and repeated on second ends E2 provides for precision gaps between ends E1 and E2. Adjustable locator 60 allows first ends E1 and second ends E2 to have the same alignment relative to abrasive surface 27 during the grinding operation. Such alignment insures that ends E1 and E2 match when abutting, and thereby prevents ends E1 and E2 from touching unevenly during expansion of rings R1 and R2. For example, when piston rings R1 and R2 are positioned around a piston inside the cylinder, ends E1 and E2 must match, otherwise, ends E1 and E2 will be misaligned with respect to one another. Such misalignment will produce unwanted separation therebetween, and could cause the piston rings to expand awkwardly.

Thus, it should be evident that piston ring grinder 10 disclosed herein carries out one or more of the objects of the present invention set forth above and otherwise constitutes an advantageous contribution to the art.

What is claimed is:

1. Apparatus for grinding the ends of a piston ring, comprising:

a base portion having a work surface for receiving the piston ring, said base portion including first and second collars;

an axle rotatably, selectively supported by one or the other of said collars of said base portion and having a first end and a second end;

a grinding wheel having an abrasive surface attached to said first end of said axle;

a handle assembly attached to said second end of said axle, said handle assembly capable of rotating said grinding wheel; and an adjustable locator selectively positioned on said work surface to engage and locate the piston ring.

2. Apparatus grinder according to claim 1, wherein said first collar and said second collar are spaced forming a gap, said grinding wheel being received in said gap.

3. Apparatus according to claim 2, wherein said abrasive surface faces to the right when said axle is supported by said first collar, and said abrasive surface faces to the left when said axle is supported by said second collar.

4. Apparatus according to claim 3, wherein said handle assembly is configured for left-hand operation when said axle is supported by said first collar, and is configured for right-hand operation when said axle is supported by said second collar.

5. Apparatus according to claim 1, further comprising a receiving hole provided through said collars for receiving said axle.

6. Apparatus for grinding the ends of a piston ring comprising a base portion having a work surface for receiving the piston ring; an axle having a first end and a second end; at least one collar extending upwardly from said base portion; a receiving hole provided through said at least one collar for rotatably receiving said axle; a channel on the circumference of said axle, said channel being adapted to receive a set screw, wherein said channel and said set screw maintain the axial position of said axle relative to said receiving hole; a grinding wheel having an abrasive surface attached to said first end of said axle; a handle assembly attached to said second end of said axle, said handle assembly capable of rotating said grinding wheel; and an adjustable locator selectively positioned on said work surface to engage and locate the piston ring.

7. Apparatus according to claim 1, wherein said handle assembly includes a crank section, said crank section having a receiving aperture shaped to receive said second end of said axle.

8. Apparatus according to claim 7, wherein said handle assembly further includes a handle attached to said crank section.

9. Apparatus according to claim 7, wherein said second end of said axle has a square shape, and said receiving aperture is shaped to match said second end.

10. Apparatus according to claim 9, further comprising an abutment shoulder formed on said axle adjacent said second end, said crank section abutting said abutment shoulder when said second end is received in said receiving aperture.

11. Apparatus according to claim 10, wherein a bolt-type fastener can be inserted into a threaded hole provided in said second end to clamp said crank section against said abutment shoulder.

12. Apparatus according to claim 1, wherein said adjustable locator is generally Y-shaped.

13. Apparatus according to claim 12, wherein the general Y-shape of said adjustable locator is formed by an elongated body portion, and angled branch sections extending outwardly from said elongated body portion.

14. Apparatus for grinding the ends of a piston ring comprising a base portion having a work surface for receiving the piston ring; an axle rotatably supported by said base portion and having a first end and a second end; a grinding wheel having an abrasive surface attached to said first end of said axle; a handle assembly attached to said second end of said axle, said handle assembly capable of rotating said grinding wheel; and an adjustable locator selectively positioned on said work surface to engage and locate the piston ring, said adjustable locator being generally Y-shaped having an elongated body portion and angled branch sections extending outwardly from said elongated body portion, said angled branch sections each providing a contact point adapted to engage the inner diameter of the piston ring.

15. Apparatus according to claim 14, further comprising a slide channel extending along said elongated body section, and adapted to receive a thumbscrew.

16. Apparatus according to claim 15, wherein said thumbscrew is inserted through said slide channel and into said base portion, and when said thumbscrew is loosed, said adjustable locator can be selectively positioned on said work surface.

* * * * *